US007556392B2

(12) United States Patent
Weigl, Jr.

(10) Patent No.: US 7,556,392 B2
(45) Date of Patent: Jul. 7, 2009

(54) ILLUMINATING UTENSIL

(76) Inventor: James A. Weigl, Jr., 315 24th St., Unit 310, Virginia Beach, VA (US) 23451

( * ) Notice: Subject to any disclaimer, the term of this patent is extended or adjusted under 35 U.S.C. 154(b) by 1 day.

(21) Appl. No.: 10/941,582

(22) Filed: Sep. 15, 2004

(65) Prior Publication Data

US 2006/0056167 A1 Mar. 16, 2006

(51) Int. Cl.

| | |
|---|---|
| ***F21K 2/00*** | (2006.01) |
| ***F21V 9/16*** | (2006.01) |
| ***B25B 23/18*** | (2006.01) |
| ***F21S 8/00*** | (2006.01) |
| ***F21K 2/06*** | (2006.01) |

(52) U.S. Cl. ..... 362/34; 362/84; 362/120; 362/426; 362/577

(58) Field of Classification Search ..... 362/34, 362/84, 426, 577, 119, 120
See application file for complete search history.

(56) References Cited

U.S. PATENT DOCUMENTS

| | | | | |
|---|---|---|---|---|
| 3,510,643 | A * | 5/1970 | File | 362/26 |
| 4,771,724 | A | 9/1988 | Baretz et al. | 116/202 |
| 4,924,358 | A * | 5/1990 | Von Heck | 362/555 |
| 5,023,761 | A * | 6/1991 | de Lange | 362/120 |
| 5,033,142 | A * | 7/1991 | Templeton | 7/167 |
| D331,889 | S | 12/1992 | Kaplan | D10/114 |
| 5,279,513 | A | 1/1994 | Connelly | 446/219 |
| 5,931,383 | A | 8/1999 | Palmer et al. | 239/33 |
| 5,961,199 | A * | 10/1999 | Lee | 362/34 |
| 6,062,380 | A | 5/2000 | Dorney | 206/217 |
| 6,226,917 | B1 * | 5/2001 | Sylla et al. | 43/42.09 |
| D452,926 | S | 1/2002 | Wu | D26/39 |
| 6,474,467 | B1 | 11/2002 | Kurdian | 206/222 |
| 6,523,778 | B2 | 2/2003 | Key et al. | 244/31 |
| 6,572,244 | B1 * | 6/2003 | Clark | 362/253 |
| 6,619,808 | B1 | 9/2003 | Pelto | 362/34 |
| 6,675,483 | B2 * | 1/2004 | Bond et al. | 30/142 |
| 6,676,269 | B1 | 1/2004 | Dorney | 362/34 |
| 6,679,614 | B2 | 1/2004 | Pittman | 362/34 |
| 6,701,720 | B1 | 3/2004 | Stone et al. | 62/4 |

(Continued)

FOREIGN PATENT DOCUMENTS

| | | |
|---|---|---|
| EP | 0980906 | 2/2000 |

(Continued)

OTHER PUBLICATIONS

Merriam-Webster's Collegiate Dictionary, 1998, Tenth Edition, pp. 1085 and 1137.*

*Primary Examiner*—Jong-Suk (James) Lee
*Assistant Examiner*—David J Makiya
(74) *Attorney, Agent, or Firm*—Lieberman & Brandsdorfer, LLC

(57) ABSTRACT

A utensil that emits light from a handle portion thereof for a limited period of time. The handle portion may be in the form of a chemiluminescent light stick, wherein a head portion of the utensil receives and holds one end of the light stick until such time as it is detached therefrom. Alternatively, the handle portion of the utensil may be in the form of a conduit sized to receive a chemiluminescent light stick. An opening of the conduit receives the light stick, and the opening is closed following insertion of the light stick into the conduit. Accordingly, the handle portion of the utensil may emit light without the use of batteries or electronic circuitry.

5 Claims, 4 Drawing Sheets

U.S. PATENT DOCUMENTS

| | | | | |
|---|---|---|---|---|
| 2001/0004318 | A1* | 6/2001 | Pitts | 362/84 |
| 2002/0058090 | A1* | 5/2002 | Siddons | 426/101 |
| 2002/0159244 | A1* | 10/2002 | Plante | 362/34 |
| 2003/0107882 | A1 | 6/2003 | Pittman | 362/34 |
| 2003/0137826 | A1 | 7/2003 | Nomiyama | 362/34 |
| 2003/0137827 | A1 | 7/2003 | Bouton et al. | 362/34 |
| 2003/0147234 | A1 | 8/2003 | Harada et al. | 362/84 |
| 2003/0176240 | A1 | 9/2003 | Redwine et al. | 473/354 |
| 2005/0180125 | A1* | 8/2005 | Yu | 362/34 |

FOREIGN PATENT DOCUMENTS

| | | |
|---|---|---|
| WO | WO9624007 | 8/1996 |
| WO | WO9938422 | 8/1999 |
| WO | WO9958898 | 11/1999 |
| WO | WO0010646 | 3/2000 |

* cited by examiner

ILLUMINATING UTENSIL

BACKGROUND OF THE INVENTION

1. Technical Field

This invention relates to a utensil adapted to be illuminated. More specifically, the invention relates to a utensil adapted to receive a chemiluminescent light stick.

2. Description of the Prior Art

Chemiluminescent light stick consist of an elongated flexible tube sealed at both ends. Two isolated chemicals are housed within the tube. One of the chemicals is stored in a self-contained glass vial within the tube. Upon breakage of the glass vial, the two chemicals mix resulting in a chemical reaction that creates a cold light for a limited duration.

There are numerous products that invite the use of a chemiluminescent light stick to provide color and illuminating characteristics. Some products are in the form of amusement products, edible compositions, and a variety of other products. For example, U.S. Pat. No. 6,471,364 to Plante discloses a lollipop with a chemiluminescent light stick. The lollipop has a candy portion comprised of an edible composition, and a stick in the form of a chemiluminescent light stick. To illuminate the handle portion of the lollipop, the stick is bent to break an internal barrier of the stick. Another example, is found in international application number WO 96/24007 to Diehl, which discloses a stemmed drinking utensil that may be illuminated. The stem of the drinking glass functions as a conduit adapted to receive a chemiluminescent light stick. Prior to inserting the light stick into the conduit of the stem, the light stick is flexed to break an internal barrier, resulting in emission of light. Thereafter, the light stick is inserted into the stem conduit to enable the stem portion of the drinking utensil to emit light.

It is further known in the art to use one or more batteries in conjunction with electronic circuitry to illuminate novelty food items. Examples of such patents include U.S. Pat. No. 4,914,748 to Schlotter et al., U.S. Pat. No. 5,471,373 to Coleman et al., and U.S. Pat. No. 6,135,606 to Fernandez et al. However, there are drawbacks associated with use of electronic circuitry and food items or items that are adapted to come into contact with the food. Some of the drawbacks include cost, safety, and the ability to clean and/or recycle the illuminated item for later use. Although it is known in the art to apply the use of a chemiluminescent light stick to a drinking utensil and to edible substances in place of electronic circuitry and batteries, there is no teaching in the art to apply the use of a chemiluminescent light stick to utensils in a safe and reliable manner. There is therefore a need for a utensil that emits light for a limited period of time in a safe and economical manner.

SUMMARY OF THE INVENTION

This invention comprises an apparatus and method for illuminating a utensil.

In one aspect of the invention, an apparatus is provided with a utensil having a head and a conduit. The conduit has a proximal end attached to the head of the utensil and a distal end that is remote from the head. The conduit is adapted to receive a chemiluminescent stick, with the distal end of the conduit receiving a cover to hold the chemiluminescent stick in the conduit.

In another aspect of the invention, an apparatus is provided with a detachable utensil head, wherein the head includes a proximal end and a distal end. A chemiluminescent stick is also provided with a proximal end and a distal end. The proximal end of the chemiluminescent stick is releasably engageable with the distal end of the detachable utensil head.

In a further aspect of the invention, an apparatus is provided having a utensil with a proximal end and a distal end. The utensil includes a head adjacent to the proximal end and a longitudinal handle extending from the head to the distal end of the utensil. The handle includes a first longitudinal portion having an internal concave groove for receiving a chemiluminescent light stick, and a second longitudinal portion having an internal concave groove for enclosing the light stick. In addition, attachment means are provided to secure the first longitudinal portion to the second longitudinal portion.

In yet another aspect of the invention, a method is provided for illuminating a utensil. A chemiluminescent light stick is illuminated. Thereafter, the illuminated light stick is inserted into a longitudinal conduit adapted to function as a handle of the utensil.

Following insertion of the illuminated light stick into the conduit, the conduit is closed to hold the light stick therein.

Other features and advantages of this invention will become apparent from the following detailed description of the presently preferred embodiment of the invention, taken in conjunction with the accompanying drawings.

BRIEF DESCRIPTION OF THE DRAWINGS

FIG. 1*a* is a side view of a utensil with a light stick as a handle.

DESCRIPTION OF THE PREFERRED EMBODIMENT

Overview

A utensil is provided with a handle that emits light. The handle may be a chemiluminescent light stick, or a conduit sized to receive a chemiluminescent light stick. In the form of the conduit, the material may be partially or completely transparent, or partially or completely translucent to enable the light from the light stick to be emitted and visible outside of the conduit. Upon expiration of the light stick, or if the user wants a utensil that emits a different color, the light stick may be replaced. If the light stick is the handle, the head and handle are detached, and the handle is replaced with a new light stick. In the case where the handle is a conduit, the conduit is opened and the light stick is replaced, following by closing the conduit. Accordingly, a utensil with a replaceable light source is provided and described herein.

Technical Details

Figure 1:
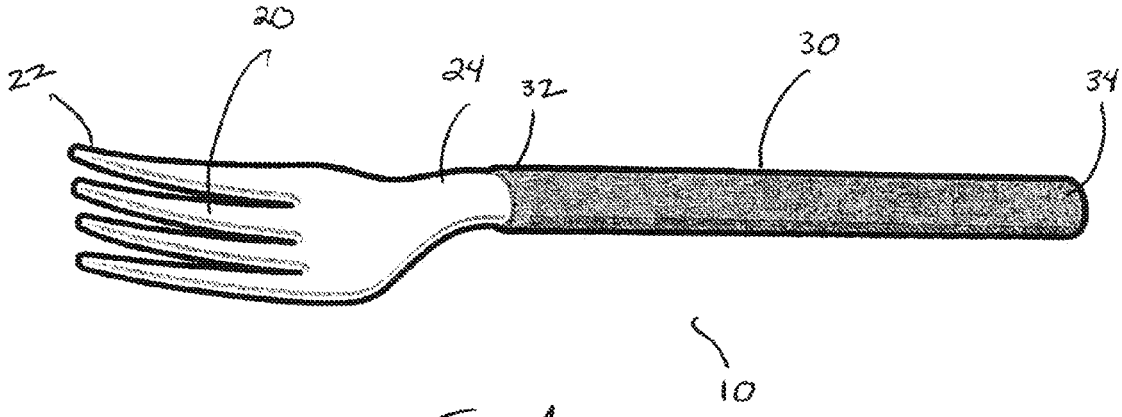
FIG. 1 is a perspective view of a utensil with a light stick as a handle.
Figure 2:
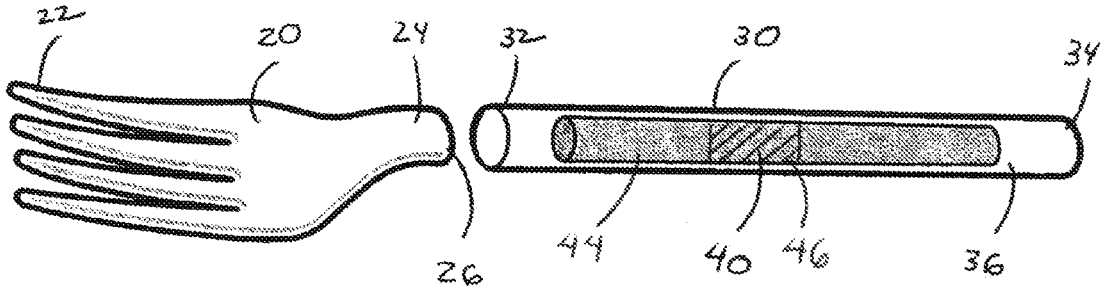
FIG. 2 is a perspective view of a utensil with a removable light stick as a handle.

FIG. 1 is a perspective view of an eating utensil (10) in one embodiment of the invention. As shown, the eating utensil is comprised of two primary components, the head (20) and the handle (30). The head has two ends, a proximal end (22) and a distal end (24). Similarly, the handle (30) includes a proximal end (32) and a distal end (34) remote from the proximal end (32), with both ends sealed. The distal end (24) of the head (20) is adapted to receive and engage the proximal end (32) of the handle (30) to form the appearance of a conventional utensil (10). FIG. 1*a* is a side view of the head (20) with an opening (28) sized to receive and engage the proximal end (32)(not shown) of the handle (30) (not shown) to form the appearance of a conventional utensil. The handle (30) and head (20) may be formed as a single cohesive unit (10), or in one embodiment, the handle (30) may be detachable from the head (20), as shown in FIG. 2. In the embodiment shown in FIG. 2, the distal end (24) of the head (20) may come in the form of a cap (26) sized to receive and hold the proximal end (32) of the handle (30). Similarly, the distal end (24) of the head (20) may include an annular groove (26) to hold the proximal end (32) of the handle (30). Accordingly, the head (20) and the handle (30) are two primary elements that securely form a utensil (10).

As shown in FIGS. 1 and 2, the handle (30) is in the form of a chemiluminescent light stick that is adapted to emit a light and provide an illuminated utensil. The handle (30) is an elongate element that extends from the distal end (24) of the head (20). The chemiluminescent light stick has a flexible or near flexible property. The light stick (30) is sealed at both the proximal and distal ends (32) and (34) to form a hollow interior (36) with a frangible enclosure (40) fitted within the hollow interior (36). The provision of the frangible enclosure (40) essentially divides the hollow interior (36) into two compartments. The hollow interior (36) contains a first chemical (44), and the frangible enclosure (40) contains a second chemical (46). The first and second chemicals (44) and (46) are selected for the property of forming a chemiluminescent reaction when combined. In general, upon bending the light stick (30), the frangible enclosure (40) will break thereby forcing the two chemicals (44) and (46) to mix and react. Following reaction of the chemicals, the light stick will emit light for a limited duration. A person may flex the light stick (30) to initiate the chemical reaction that provides the illumination prior to or following the process of attaching the light stick (30) to the utensil head (20). In an example where the light stick (30) is flexed prior to securing the light stick (30) to the utensil head (20), following the chemical reaction, the proximal end (32) of the light stick (30) is attached to the distal end of the utensil head (24). Alternatively, the light stick (30) may be flexed following attachment to the utensil head (20). In either situation, the light stick (30) has sufficient strength to provide support for use as a handle of a utensil. Accordingly, the handle of the utensil is in the form of a light stick that is either illuminated or adapted to emit light following an internal chemical reaction.

Figure 3:
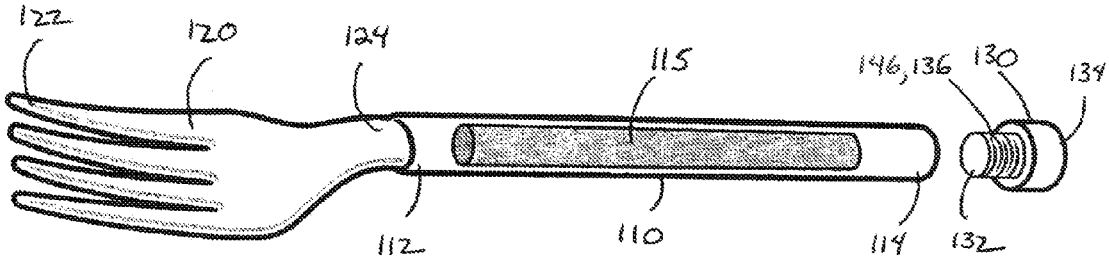
FIG. 3 is a perspective view of a utensil with a handle in the form of a conduit with a closing element.

FIG. 3 is a perspective view of another embodiment for modifying a utensil (100) to include a handle (110) adapted to emit light. The utensil (100) includes a head (120) with a proximal end (122) and a distal end (124), and an elongated handle (110) with a proximal end (112) and a distal end (114). The proximal end (112) of the handle (110) is adjacent to the distal end (124) of the head (120). The head (120) and handle (110) may be detachable as shown in FIG. 2, or they may be formed as a single cohesive unit. In either formation, the handle (110) is in the form of a conduit that is sized to receive a chemiluminescent light stick (115). The conduit may be flexible so that the conduit, i.e. handle (110), with the light stick (115) therein, may be flexed to initiate the chemical reaction. Alternatively, the conduit (110) may have a more stiff characteristic that requires the light stick (115) to be flexed prior to insertion in the conduit (110). In either scenario, the light stick (115) is inserted into the conduit and secured therein with a closing element (130). Accordingly, the utensil (100) includes a head (120), and a handle (110) in the form of a conduit sized to receive a chemiluminescent light stick (115).

Figure 4:
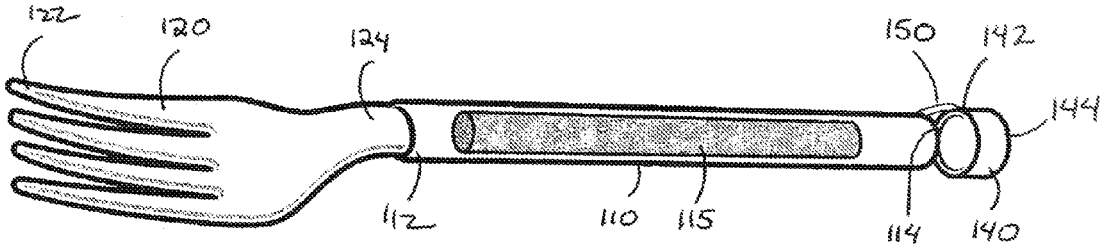
FIG. 4 is a perspective view of a utensil with a handle in the form of a conduit with an alternative closing element.
Figure 5:
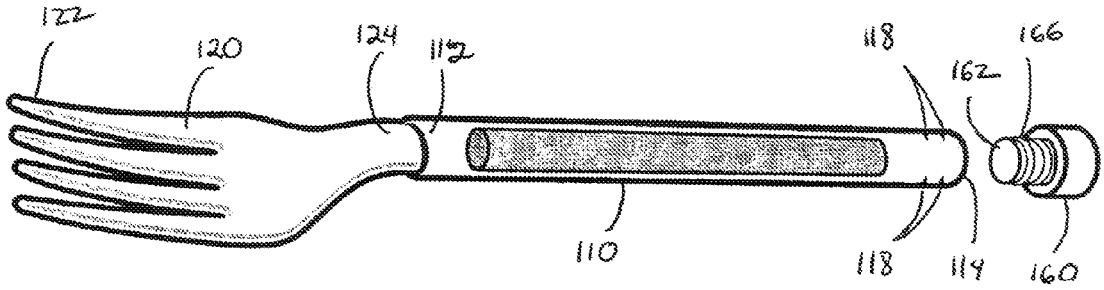
FIG. 5 is a perspective view of a utensil with a handle in the form of a conduit with an alternative closing element

As shown in FIG. 3, the closing element (130) has a proximal end (132) and a distal end (134), with the proximal end (132) of the closing element (130) having a threaded exterior surface (136), and the circumference of the distal end (134) being greater than the circumference of the distal end of the conduit (114) to enable removal of the closing element (130) from the conduit (110). Similarly, the distal end (114) of the conduit (110) has a threaded interior surface (not shown) to receive the threaded exterior surface (136) of the closing element (130). In another embodiment, the interior surface of the closing element (130) may be threaded to be received by a threaded exterior surface of the conduit (110). Furthermore, the closing element (130) may be in the form of a cap (140), as shown in FIG. 4. The cap may be a solitary unit (140) that is remote from the conduit (110), as shown in FIG. 3. In one embodiment, the cap (140) may be attached to the distal end (114) of the conduit (110) by a tether (150) to prevent loss of the cap at such time as it is not secured to the distal end (114) of the conduit (110). The cap (140) has a proximal end (142) and a distal end (144), with the proximal end (142) having an extension (146) with an external circumference less than an internal circumference of the distal end (114) of the conduit (110) so that the proximal end of the cap is received in the distal end of the conduit. Alternatively, the proximal end (142) of the cap (140) may have a circumference greater than the circumference of the distal end (114) of the conduit (110) so that the proximal end of the cap receives the distal end of the conduit. In one embodiment, the internal surface area of the distal end (114) of the conduit (110) may one or more projections (118), as shown in FIG. 5, and the external surface of the proximal end (162) of the cap (160) may include one or more grooves (166). Upon insertion of the cap (160) into the distal end (114) of the conduit (110), the groove(s) (166) would be received and held in place by the projection(s) (118). To illuminate the handle (110) of the utensil, the light stick may be flexed to initiate the chemical reaction and then inserted into the conduit (110) followed by attachment of the cap (130) or (160) to the distal end (114) of the conduit (110). In one embodiment, the conduit (110) may have sufficient flexibility to enable a person to insert the light stick into the conduit (110) and close the distal end (114) of the conduit (110) with the cap (130) or (160) prior to initiating the chemical reaction of the light stick. The person may flex the conduit (110) with the light stick ( ) therein. Accordingly, in either scenario, the handle of the light stick is a conduit to receive an illuminated or illuminatable light stick.

Figure 6:
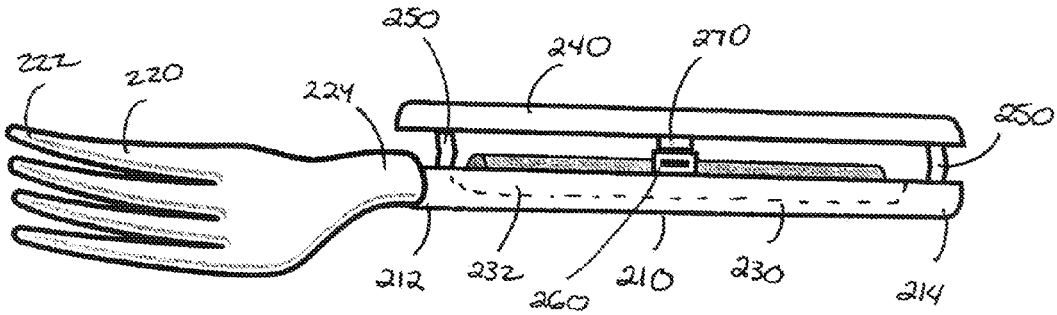
FIG. 6 is a perspective view of a utensil with a handle in the form of a split conduit.

FIG. 6 is a perspective view of another embodiment of a utensil (200) modified to receive a chemiluminescent light stick. As shown, the utensil includes a head (220) having a proximal end (222) and a distal end (224), and an elongated handle (210) having a proximal end (212) and a distal end (214). The proximal end (212) of the handle (210) is adjacent to the distal end (224) of the head (220). The head (220) and handle (210) may be detachable as shown in FIG. 1, or they may be formed as a single cohesive unit. In either formation, the handle (210) is in the form of a split conduit having a first portion (230) and a second portion (240). The first portion (230) and the second portion (240) may be held together by an attachment element (250), such as a hinge (250) or a tether (not shown). The purpose of the hinge (250) is to hold the first and second portions (230) and (240), respectively, in a spaced relationship prior to insertion or removal of the light stick from the conduit (210). The first portion of the split conduit (210) has a concave groove (232). Similarly, the second portion of the split conduit (210) has a concave groove (not shown), with each groove sized to receive a chemiluminescent light stick. The first and second portions (230) and (240), respectively, may be the same size or they be different sizes. Regardless of the size of the portions (230) and (240), one of the grooves is sized to receive the light stick, and following placement of the light stick in one of the grooves (232) or (242), the other portion of the conduit (210) and the associated groove covers the remaining exposed portion of the light stick. In addition to the grooves (232) and (242), each portion (230) and (240) of the conduit (210) preferably includes an attachment mechanism (260) and (270) to hold the portions (230) and (240) of the conduit (210) in a closed position thereby preventing removal of the light stick from the conduit (210). For example, the attachment mechanism (260) may be in the form of a male extension (270) on the second portion (240) that is adapted to be received by a female receiving element (260) on the first portion (230). Accordingly, the utensil includes a head, and a handle in the form of a split conduit with a groove therein sized to receive a chemiluminescent light stick.

In relation to the embodiment shown in FIG. 6, the light stick may be flexed to initiate the chemical reaction and then inserted into the handle (210) followed by attachment of the first and second portions (230) and (240) of the handle (210). However, in one embodiment, the handle (210) may have sufficient flexibility to enable a person to insert the light stick into the handle prior to initiating a chemical reaction. For example, the light stick may be placed in the groove (232) of the first portion (234) of the handle (210), followed by closing the first portion (230) with the second portion (240) to form the handle (210), wherein the groove (242) of the second portion (240) of the handle encloses the light stick. Once the first and second portions (230) and (240) of the handle (210) are in a closed position, the person may flex the handle (210) with the light stick therein.

Figure 7A:
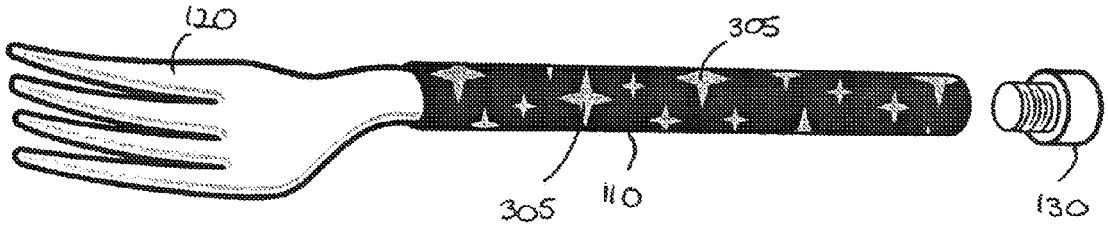
FIGS. 7*a*, 7*b*, and 7*c* show a utensil with a cover over the handle portion.
Figure 7B:
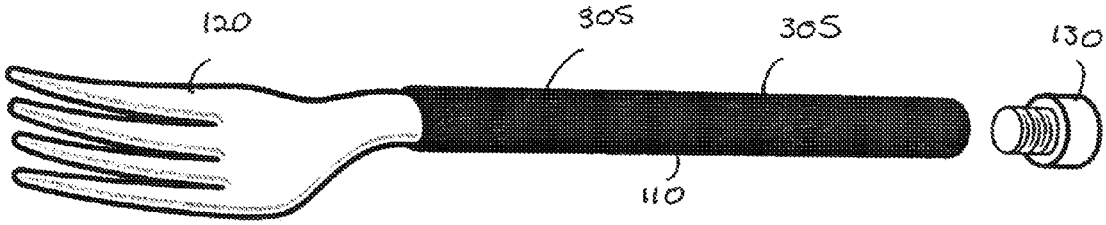
Figure 7C:
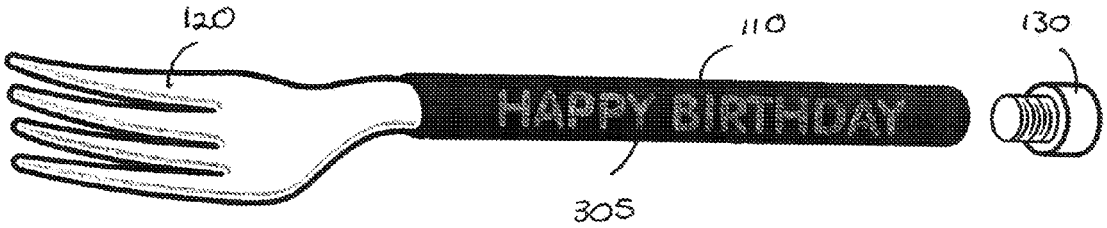

In each of the embodiments of the invention wherein the handle of the utensil is in the form of a conduit for receiving the light stick, the conduit is made from a material that enables the light to be transmitted. For example, the conduit may be made of a transparent or translucent material. Similarly, the conduit may be made from a partially transparent or partially translucent material, as shown in FIGS. 7*a*, 7*b*, and 7*c*. In the latter formation, the transparent material portions of the conduit may be made of shapes or indicia, so that as light is transmitted through the transparent portions (305), a person would see shapes of color along the conduit. In addition, the material of the handle and/or the utensil head may be made from the same material, or from dissimilar materials if they are detachable. The material of either the handle or the utensil head may be plastic or metallic. Since there are no batteries or electronic circuitry, the handle and/or utensil head portions may be reused following a cleaning process. Similarly, in the embodiments where the handle is a conduit, the light stick may be replaced with another light stick. This may be desirable when the emission of light of the light stick in the conduit expires, or if a user of the utensil desires to transmits a different color. In the embodiment where the light stick forms the handle of the utensil, the user merely detaches the light stick from the head when the emission of light of the light stick in the conduit expires, or if a user of the utensil desires to transmits a different color. Accordingly, the use of light sticks associated with utensils provides a lot of flexibility for changing color emission or replacing an expired or expiring light stick.

Advantages Over the Prior Art

A utensil that can be illuminated with a chemiluminescent light stick emits light for a limited duration without the use of a battery and electronic circuitry. Either the head or handle of the utensil is modified to receive the chemiluminescent light stick. In one embodiment, the light stick becomes the handle of the utensil, and in another embodiment, the handle is a conduit sized to receive a light stick. The lights stick in each of the embodiments are replaceable at the discretion of the user.

Alternative Embodiments

It will be appreciated that, although specific embodiments of the invention have been described herein for purposes of illustration, various modifications may be made without departing from the spirit and scope of the invention. In particular, the illuminating handle with a utensil head may be expanded to include a writing utensil, such as a pencil or pen. The ink or lead for the writing implement would be in the head of the utensil, and the handle either be a chemiluminescent light stick, or a conduit adapted to receive the chemiluminescent light stick. Accordingly, the scope of protection of this invention is limited only by the following claims and their equivalents.

The invention claimed is:

1. An apparatus comprising:

an eating utensil having a proximal end and a distal end;

said utensil having a head adjacent to said proximal end and a longitudinal handle extending from said head to said distal end of said utensil;

said handle having a first longitudinal portion having an internal concave groove to receive a chemiluminescent light stick, and a second longitudinal portion having an internal concave groove to enclose said light stick; and attachment means to secure said first longitudinal portion to said second longitudinal portion.

2. The apparatus of claim 1, wherein said longitudinal handle and said head are interchangeably created from material selected from a group consisting of: metallic, plastic, and combinations thereof.

3. The apparatus of claim 1, wherein said longitudinal handle material has a characteristic selected from a group consisting of: transparent, translucent, partially transparent, partially translucent, solid with openings to transmit light, and combinations thereof.

4. The apparatus of claim 1, further comprising a hinge adapted to hold said first portion to said second portion.

5. The apparatus of claim 1, wherein said utensil head is selected from a group consisting of: a fork, a spoon, and a knife.

* * * * *